US009466902B2

(12) United States Patent
Fujimoto et al.

(10) Patent No.: US 9,466,902 B2
(45) Date of Patent: Oct. 11, 2016

(54) METHOD OF PRODUCING A DETECTOR

(71) Applicant: FANUC CORPORATION, Yamanashi (JP)

(72) Inventors: Taisei Fujimoto, Yamanashi (JP); Hirofumi Kikuchi, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 73 days.

(21) Appl. No.: 14/618,276

(22) Filed: Feb. 10, 2015

(65) Prior Publication Data

US 2015/0229052 A1 Aug. 13, 2015

(30) Foreign Application Priority Data

Feb. 12, 2014 (JP) ..... 2014-024903

(51) Int. Cl.

| | |
|---|---|
| ***H01R 12/24*** | (2006.01) |
| ***H01R 12/75*** | (2011.01) |
| ***H01R 12/71*** | (2011.01) |
| ***H01R 12/79*** | (2011.01) |
| *H01R 12/77* | (2011.01) |

(52) U.S. Cl.

CPC ..... *H01R 12/75* (2013.01); *H01R 12/716* (2013.01); *H01R 12/79* (2013.01); *H01R 12/772* (2013.01); *Y10T 29/49151* (2015.01)

(58) Field of Classification Search

CPC .. H01R 12/716; H01R 12/75; H01R 12/772; H01R 12/79; Y10T 29/49151

See application file for complete search history.

(56) References Cited

U.S. PATENT DOCUMENTS

| | | | | |
|---|---|---|---|---|
| 3,825,886 | A * | 7/1974 | Thigpen | G01V 1/16 367/177 |
| 2008/0076987 | A1* | 3/2008 | Arizaga Ballesteros | A61B 5/02444 600/323 |

FOREIGN PATENT DOCUMENTS

| | | | |
|---|---|---|---|
| JP | S60088414 | U | 6/1985 |
| JP | 2005116288 | A | 4/2005 |
| JP | 2006228768 | A | 8/2006 |
| JP | 3169040 | U | 6/2011 |

OTHER PUBLICATIONS

English abstract for Japanese Publication No. JP 2006-228768 published Aug. 31, 2006,1 pg.

Translated Decision to Grant a Patent for JP2014-024903, Date of Mailing: Feb. 2, 2016, 3 pages.

Untranslated Decision to Grant a Patent for JP2014-024903, Date of Mailing: Feb. 2, 2016, 3 pages.

Translated Decision of Refusal for JP2014-024903, Date of Mailing: Sep. 1, 2015, 3 pages.

Untranslated Decision of Refusal for JP2014-024903, Date of Mailing: Sep. 1, 2015, 3 pages.

Translated Notification of Reasons for Refusal for JP2014-024903, Date of Mailing: Jun. 16, 2015, 3 pages.

Untranslated Notification of Reasons for Refusal for JP2014-024903, Date of Mailing: Jun. 16, 2015, 3 pages.

English Translation of Japanese Publication No. 2005116288A, published Apr. 28, 2005, 10 pages.

Untranslated Office Action for Japanese Patent Application No. 2014-024903, mailing date: Jun. 16, 2015; 2 pages.

English Translation of Office Action for Japanese Patent Application No. 2014,024903, mailing date: Jun. 16, 2015, 5 pages.

* cited by examiner

*Primary Examiner* — Carl Arbes

(74) *Attorney, Agent, or Firm* — Fredrikson & Byron, P.A.

(57) ABSTRACT

A detector comprising a circuit board, a board-side connector which is mounted on the circuit board, and a flexible cable which has a terminal part inserted in the board-side connector, wherein a reinforcement member of the flexible cable is attached to an end part of the flexible cable which includes the terminal part, and the reinforcement member includes a foldable part which allows local bending of the end part of the flexible cable.

3 Claims, 4 Drawing Sheets

METHOD OF PRODUCING A DETECTOR

BACKGROUND OF THE INVENTION

1. Field of the Invention

The present invention relates to a detector with a flexible cable for inputting/outputting signals to/from a circuit board, and a method of producing a detector.

2. Description of the Related Art

In the field of electronic equipment, various flexible cables are often used for inputting/outputting signals to/from circuit boards. Flexible cables are soft and thin, in addition to being inexpensive, and therefore it is possible not only to reduce the manufacturing costs, but also to realize a smaller size, in particular a reduced thickness, of the equipment. When a clamp-type connector is mounted on a circuit board of an electronic apparatus, the terminal part of the flexible cable is inserted into the clamp-type connector so that the metal terminal part of the clamp-type connector is pressed against the dielectric patterns of the terminal part of the flexible cable. Prior to the insertion, a reinforcement member having a high rigidity is often attached to the end part of the flexible cable which includes the terminal part, so as to ensure that the highly pliant flexible cable can be securely inserted into the clamp-type connector. Such a reinforcement member can also serve as a clamped part which is clamped together with the flexible cable by the clamp-type connector. In relation to this, JP-A-2006-228768 discloses a connection structure of an FFC and circuit board in which a reinforcement plate stuck to a back surface of the flexible flat cable (FFC) is inserted together with the FFC into an insertion slot of the circuit board. Furthermore, JP-A-2006-228768 proposes the art of using lock parts which are formed on the reinforcement plate of the FFC to protrude from both its side surfaces, so as to prevent the FFC from inadvertently being detached from the insertion slot.

FIG. 8 is a cross-sectional view which shows the structure of a conventional electronic apparatus, employing a reinforcement member which serves as a clamped part to be clamped by a clamp-type connector. The electronic device of FIG. 8 is an optical encoder comprising a slit disk 81 connected with a rotary member, a light emitting element 82 for emitting a light beam toward the slit disk 81, a light receiving element 83 for receiving a light pulse which passes through the slit disk 81, and a circuit board 84 on which the light receiving diode 83 is mounted. As shown in FIG. 8, a general, clamp-type connector 85 is also attached to the circuit board 84. A reinforcement member 87 stuck to the end part of the flexible cable 86 is inserted together with the flexible cable 86 into the clamp-type connector 85. Such an optical encoder is preferably small and thin, but to securely insert the flexible cable 86 and the reinforcement member 87 into the clamp-type connector 85, it is necessary that the reinforcement member 87 have a certain extent of height. However, if the reinforcement member 87 becomes larger in height, as shown in FIG. 8, the dimension of the detector ends up becoming larger in the height direction of the reinforcement member 87, and therefore the detector cannot achieve a smaller size, in particular a reduced thickness.

A detector which can realize smaller size, in particular, reduced thickness, even if a reinforcement member is attached to the flexible cable, is being sought.

SUMMARY OF INVENTION

According to a first aspect of the present invention, there is provided a detector comprising a circuit board, a connector which is mounted on the circuit board, and a flexible cable which has a terminal part inserted in the connector, wherein, a reinforcement member of the flexible cable is attached to an end part of the flexible cable which includes the terminal part, and the reinforcement member includes a foldable part which allows local bending of the end part of the flexible cable.

According to a second aspect of the present invention, there is provided a detector in the first aspect, wherein the foldable part includes a weakened part.

According to a third aspect of the present invention, there is provided a detector in the second aspect, wherein the weakened part is a slit which is formed on the reinforcement member.

According to a fourth aspect of the present invention, there is provided a detector in any one of the first to third aspects, wherein the reinforcement member is split at the foldable part.

According to a fifth aspect of the present invention, there is provided a detector in any one of the first to fourth aspects, wherein the reinforcement member includes a plurality of foldable parts.

According to a sixth aspect of the present invention, there is provided a method of producing a detector according to any one of the first to fifth aspects, comprising inserting the terminal part of the flexible cable together with the reinforcement member into the connector, and locally bending the end part of the flexible cable along the foldable part.

According to a seventh aspect of the present invention, there is provided a method of producing a detector in the sixth aspect, further comprising attaching to the reinforcement member, an immobilizing member which immobilizes the foldable part so that the end part of the flexible cable cannot be bent, inserting into the connector, the terminal part of the flexible cable together with the reinforcement member having the immobilizing member attached thereto, detaching the immobilizing member from the reinforcement member, and locally bending the end part of the flexible cable along the foldable part.

These and other objects, features, and advantages of the present invention will become more apparent in light of the detailed description of exemplary embodiments thereof as illustrated by the drawings.

DETAILED DESCRIPTION OF EMBODIMENTS

Below, embodiments of the present invention will be explained in detail with reference to the drawings. In the figures, similar component elements are assigned similar reference notations. Note that the following explanation does not limit the technical scope of the inventions which are described in the claims or the meaning of terms etc.

Figure 1:
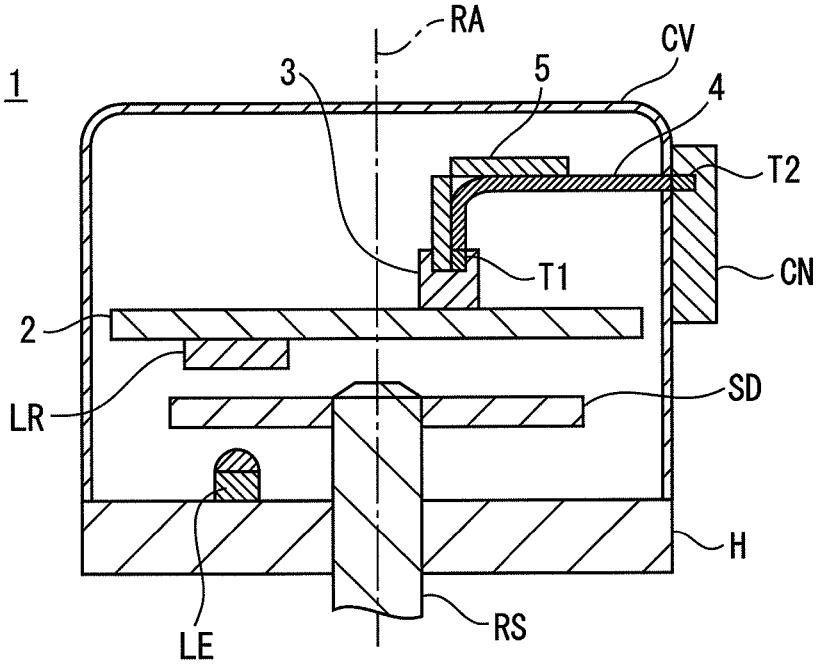
FIG. 1 is a cross-sectional view of a detector according to one embodiment of the present invention.

Referring to FIG. 1 to FIG. 7, a detector of one embodiment of the present invention will be explained. The detector of the present embodiment is an optical encoder for converting an angular position of a rotary shaft which is coupled to a rotary member, to a digital signal for output. FIG. 1 is a cross-sectional view of an illustrative detector 1 of the present embodiment.

As shown in FIG. 1, the detector 1 of this example comprises a rotary member (not shown), for example, a rotary shaft RS which is connected with a drive shaft of an electric motor or a driven body which is driven to rotate by a drive shaft of an electric motor, a slit disk SD which is connected to one end part of the rotary shaft RS, and a circuit board 2 which is arranged above the slit disk SD. The rotary shaft RS of the present example is supported by a disk shaped housing H so that it can rotate about a rotational axis RA. A cover CV is attached to the housing H for covering the above components. Further, a connector CN is mounted on the cover CV of the present example, for electrically connecting the detector 1 to outside equipment. This connector CN may be referred to below as the "cover side connector CN". As shown in FIG. 1, the cover CV of the present example has a cylindrical shape with a closed top part.

As shown in FIG. 1, the detector 1 of the present example further comprises a light emitter LE which is mounted on a housing H so as to face a bottom surface of the slit disk SD, and a light receiver LR which is mounted on the circuit board 2 so as to face a top surface of the slit disk SD. The light emitter LE of the present example has a light emitting diode such as a red LED (light emitting diode) or infrared LED. The light receiver LR of the present example has a light receiving diode such as a photodiode or phototransistor. The circuit board 2 of the present example is a printed circuit board, on which various electronic devices and integrated circuits as well as interconnects for connecting these devices and circuits are mounted. In particular, a connector 3 is also mounted on the circuit board 2 of the present, in addition to the above light receiver LR, and a flexible cable 4 is mounted on the connector 3. Below, the connector 3 mounted to the circuit board 2 may be referred to as a "board-side connector 3" to differentiate it from the above-mentioned cover-side connector CN. The board-side connector 3 and the flexible cable 4 of the present example will be explained further later.

During operation of the detector of the present example, the light emitter LE emits a light beam substantially parallel to the rotational axis RA of the slit disk SD toward the slit disk SD. The slit disk SD is provided with a plurality of slits which are aligned about the rotational axis RA in the circumferential direction, and is designed to switch transmission/non-transmission of the light beam in accordance with its angular position about the rotational axis RA. That is, the light beam emitted from the light emitter LE to the slit disk SD is converted into a light pulse having light/dark patterns corresponding to the angular position of the slit disk SD. Further, the light receiver LR converts the light pulse which passes through the slit disk SD to an electrical signal for output. The thus output electrical signal is used as the basis to detect the angular position and rotational speed etc. of the rotary shaft RS which is connected to the slit disk SD.

Figure 2:
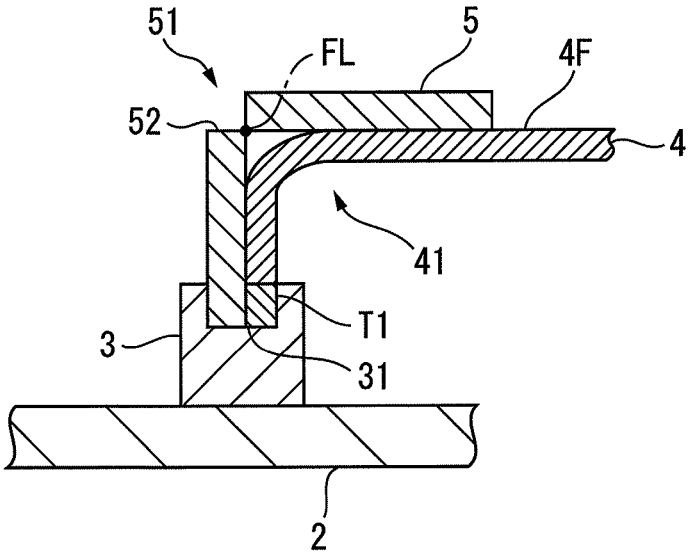
FIG. 2 is a partial enlarged view which shows a board-side connector and its vicinity in the detector of FIG. 1.

Next, the board-side connector 3 and the flexible cable 4 in the detector 1 of the present embodiment will be explained. FIG. 2 is a partial enlarged view which shows the board-side connector 3 in the detector 1 of FIG. 1. As shown in FIG. 2, the connector 3 of the present example is formed with a recessed part 31 of a dimension corresponding to one terminal part T1 of the flexible cable 4. This recessed part 31 is provided with a metal terminal part (not shown) which is electrically connected to a terminal part T1 of the flexible cable 4. That is, the connector 3 of the present example is designed to clamp the terminal part T1 of the flexible cable 4 which is inserted into the recessed part 31. This type of connector is generally referred to as a "clamp-type connector".

The flexible cable 4 of the present example is a thin cable which comprises a plurality of flat conductors arranged in parallel, and an insulating material covering these conductors. Such a cable is generally called an FFC (flexible flat cable). The flexible cable 4 of the present example has a high flexibility and can be bent into any shape in accordance with the internal structure of the detector 1. As shown in FIG. 2, a reinforcement member 5 is attached to one end part 41 of the flexible cable 4 which includes the terminal part T1, and the reinforcement member 5 has a higher rigidity than the flexible cable 4. More specifically, the reinforcement member 5 of the present example has the shape of a bent sheet which is formed by bending a flat sheet at substantial a right angle, and is stuck to one wide surface of the thin flexible cable 4 by an adhesive. Below, the wide surface of the flexible cable 4 to which the reinforcement member 5 is stuck may be referred to as the "front face 4F". Further, the other end part of the flexible cable 4 is provided with a terminal part T2 which is connected to metal terminal part (not shown) of the housing side connector CN (see FIG. 1). The reinforcement member 5 of the present example will be explained in detail below.

The reinforcement member 5 of the present example has the function of reinforcing a flexible cable 4 so that the end part 41 of the flexible cable 4 cannot be bent while being inserted into the board-side connector 3. Furthermore, since the reinforcement member 5 of the present example is inserted into the recessed part 31 of the board-side connector 3 together with the terminal part T1 of the flexible cable 4, it also serves as a clamped part which is clamped by the clamp-type, board-side connector 3. The reinforcement member 5 of the present example has a dimension in the width direction which is substantially equal to the flexible cable 4. The width direction which is referred to herein means a direction vertical to the surface of FIG. 1 and FIG. 2. However, the reinforcement member 5 of the present example may also have a dimension in the width direction which is smaller than the flexible cable 4 so long as the end part 41 of the flexible cable 4 can be suitably reinforced. The reinforcement member 5 of the present example is formed from various plastic materials or metal materials which have higher rigidity than a flexible cable 4.

As shown in FIG. 2, the reinforcement member 5 of the present example includes a foldable part 51 which can be folded and deformed along a fold line FL which intersects with the extension direction of the flexible cable 4. The "extension direction of the flexible cable 4" herein means the direction along which the flexible cable 4 extends from one terminal part T1 to the other terminal part T2. Further, the concept of "folded and deformed" herein involves both the reinforcement member 5 being folded along the fold line FL, and the reinforcement member 5 being split along the fold line FL. In particular, the foldable part 51 of the present example can be folded and deformed along the fold line FL which intersects perpendicularly with the extension direction of the flexible cable 4. Further, the end part 41 of the flexible cable 4 can be locally bent along the shape of the foldable part 51 after being folded and deformed. In the example of FIG. 2, the foldable part 51 of the reinforcement member 5 is folded and deformed at substantial a right angle, and therefore the end part 41 of the flexible cable 4 is bent at substantial a right angle. In this way, the reinforcement member 5 of the present example allows local bending of the end part 41 of the flexible cable 4 which is mounted on the board-side connector 3, and therefore the detector 1 can be a smaller size, and in particular, reduced thickness even when a reinforcement member 5 attached to the flexible cable 4.

Further, as shown in FIG. 2, the foldable part 51 of the example includes a thin weakened part 52. The weakened part 52 of the example has the form of a slit which extends along the fold line FL. This ensures that the foldable part 51 of the reinforcement member 5 can be easily folded and deformed along the fold line FL. However, the weakened part 52 of the foldable part 51 of the present example may also have a form different from the slit such as in FIG. 2. For example, the weakened part 52 may have the form of perforations extending along the fold line FL. Note that, the reinforcement member 5 of the present example is stuck to the front face 4F of the flexible cable 4 by an adhesive, and therefore the majority of the reinforcement member 5 is kept in contact with the front face 4F of the flexible cable 4 as shown in FIG. 2 even after the foldable part 51 is folded and deformed.

Figure 3:
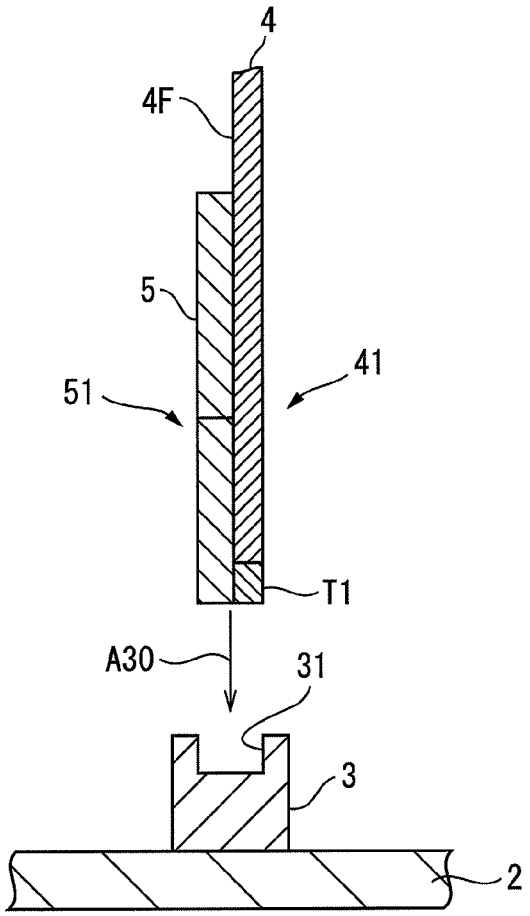
FIG. 3 is a view for explaining a cable attachment process in a method of producing a detector of FIG. 1.

Next, referring to FIG. 3, the method of producing the detector 1 according to the present example will be explained. The method of producing the detector 1 according to the present example includes a cable attachment process for attaching a flexible cable 4 to a board-side connector 3. In the cable attachment process of the present example, first, the terminal part T1 of the flexible cable 4 is inserted together with the reinforcement member 5 into a recessed part 31 of the board-side connector 3. FIG. 3 is a cross-sectional view, similar to FIG. 2, which shows the state where the terminal part T1 of the flexible cable 4 is yet to be inserted into the recessed part 31 of the board-side connector 3. As shown in FIG. 3, until the terminal part of the flexible cable 4 is inserted into the recessed part 31 of the board-side connector 3, the reinforcement member is held in a state where the foldable part 51 is yet to be bent and deformed, that is, in a state where it still takes the form of a flat plate extending in one direction. This prevents bending of the end part 41 of the flexible cable 4, and therefore it is possible to securely insert the terminal part T1 of the flexible cable 4 into the recessed part 31 of the board-side connector 3. The arrow mark A30 in FIG. 3 shows the direction of insertion of the flexible cable 4 during the cable attachment process of the present example. Next, once the insertion of the terminal part T1 of the flexible cable 4 is finished, the foldable part 51 is folded and deformed, and the end part 41 of the flexible cable 4 is locally bent along the shape of the foldable part 51 after being folded and deformed (see FIG. 2). Thereafter, the cable attachment process is ended.

Note that, when the foldable part 51 includes a slit shaped weakened part 52, the foldable part 51 after being folded and deformed can be split into two parts along the fold line FL. More specifically, the foldable part 51 after being folded and deformed can be split into an insertion part which is inserted into the board-side connector 3 together with the terminal part T1 of the flexible cable 4, and a non-insertion part which is positioned on the opposite side of the insertion part across the fold line FL (see FIG. 2). Nonetheless, since the flexible cable 4 and the reinforcement member 5 of the present example are stuck to each other across the entire contact surfaces, the non-insertion part of the reinforcement member 5 will never drop off from the front face 4F of the flexible cable 4 even when the reinforcement member 5 is split into the two parts. Further, when the foldable part 51 is split after being folded and deformed, it is possible to freely change the bent shape of the end part 41 of the flexible cable 4 after insertion into the board-side connector 3, and thus improve the degree of freedom of design of the detector 1.

Figure 4:
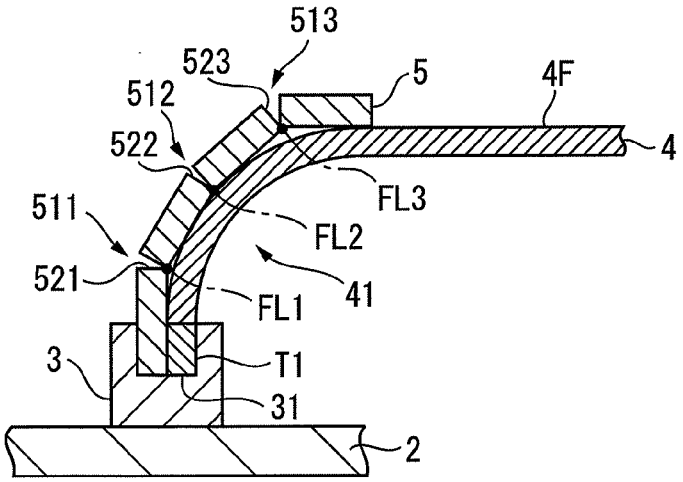
FIG. 4 is a cross-sectional view which shows a board-side connector and its vicinity in a detector which employs a modification of the reinforcement member.

Next, a modification of the reinforcement member 5 in the detector 1 of the present embodiment will be explained. FIG. 4 is a cross-sectional view, similar to FIG. 2, which shows a board-side connector 3 and its vicinity in a detector 1 which employs a reinforcement member 5 of the present example. As shown in FIG. 4, the reinforcement member 5 of the present example includes a plurality of foldable parts 511, 512, 513 which can be folded and deformed along a plurality of fold lines FL1, FL2, FL3 intersecting with the extension direction of the flexible cable 4. More specifically, the reinforcement member 5 of the present example includes three foldable parts 511, 512, 513 which can be folded and deformed along the three fold lines FL1, FL2, FL3 intersecting perpendicularly with the extension direction of the flexible cable 4. Further, these three foldable parts 511, 512, 513 include slit shaped weakened parts 521, 522, 523. As shown in FIG. 4, according to the reinforcement member 5 of the present example, the end part 41 of the flexible cable 4 is gradually bent along the shapes of the three foldable parts 511, 512, 513, and therefore the curvature rate of the end part 41 of the flexible cable 4 becomes larger. Therefore, according to the reinforcement member 5 of the present example, it is possible to easily bend the end part 41 of the flexible cable 4 which is mounted on the board-side connector 3. Furthermore, according to the reinforcement member 5 of the present example, it is possible to increase contact areas between the folded and deformed reinforcement member 5 and flexible cable 4, thus prevent the reinforcement member 5 from dropping off the front face 4F of the flexible cable 4.

Figure 5:
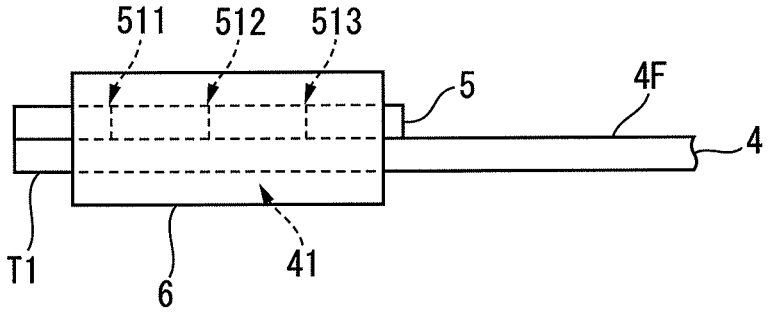
FIG. 5 is a side view which shows a state where an immobilizing member has already been attached to the reinforcement member in FIG. 4.
Figure 6:
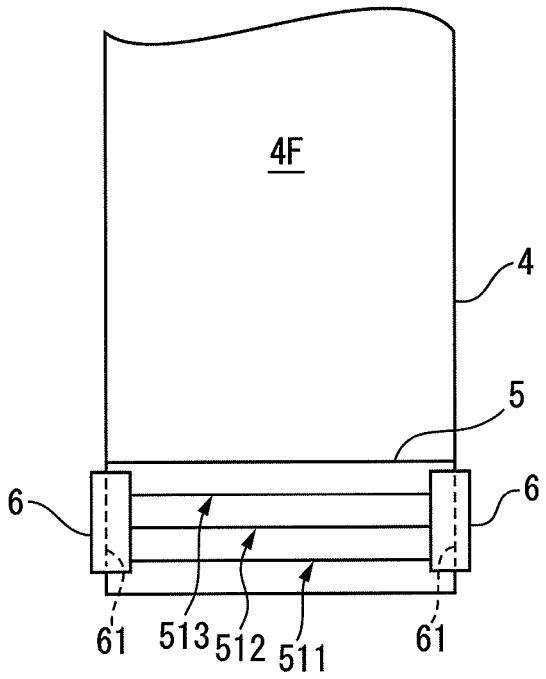
FIG. 6 is a front view which shows the front face of the flexible cable in FIG. 5.
Figure 7:
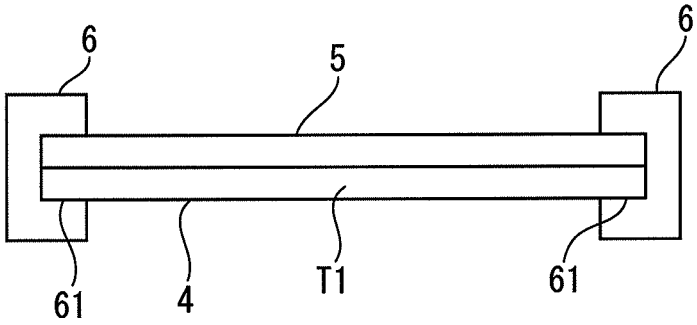
FIG. 7 is a bottom view which shows a terminal part of the flexible cable in FIG. 5.
Figure 8:
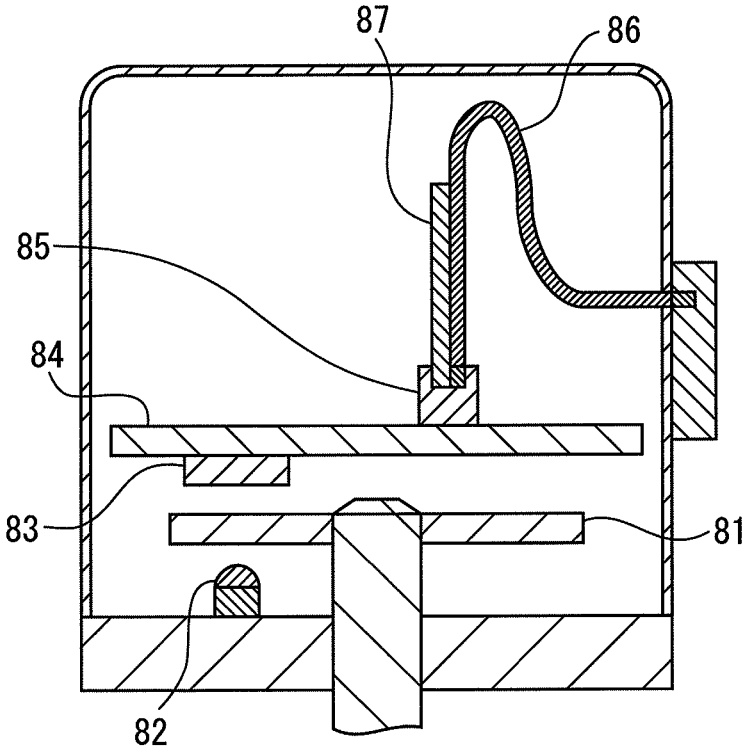
FIG. 8 is a cross-sectional view of a conventional detector.

Next, a method of producing the detector 1 which employs the reinforcement member 5 of FIG. 4 will be explained. In the cable attachment process in the method of producing a detector 1 according to the present example, first, a pair of immobilizing members 6, 6 for immobilizing the foldable parts 511, 512, 513 of the reinforcement member 5 are attached to both the side parts of the reinforcement member 5. FIG. 5 is a side view which shows a state where the immobilizing member 6 has already been attached to the reinforcement member 5 in FIG. 4. Further, FIG. 6 is a front view which shows the front face 4F of the flexible cable 4 in FIG. 5, while FIG. 7 is a bottom view which shows a terminal part T1 of the flexible cable 4 in FIG. 5. As will be understood from FIG. 5 to FIG. 7, each of the immobilizing members 6, 6 takes the form of an elongated body which extends in one direction, and a groove part 61 extending along the extension direction the elongated body is formed on one side surface of each immobilizing member 6. Further, as shown in FIG. 7, the groove part 61 of the immobilizing member 6 of the present example has a dimension corresponding to the side part of the flexible cable 4 with the reinforcement member 5 being stuck thereto. Therefore, when the immobilizing member 6 is attached to the side part of the reinforcement member 5, the side part of the reinforcement member 5 is fit into the groove part 61 of the immobilizing member 6, together with the side part of the flexible cable 4. This ensures that the foldable parts 511, 512, 513 of the reinforcement member 5 are immobilized in a state where they are yet to folded and deformed, that is, in a state where the reinforcement member 5 still takes the form of a flat plate extending along the extension direction of the immobilizing members 6.

In the cable attachment process of the present example, next, the terminal part T1 of the flexible cable 4 is inserted into the recessed part 31 of the board-side connector 3. During this step, the foldable parts 511, 512, 513 of the reinforcement member 5 are immobilized by the pair of immobilizing members 6, 6 so as not to be folded and deformed, and therefore the end part 41 of the flexible cable 4 is never bent. Therefore, according to the immobilizing member 6 of the present example, it is possible to securely insert the terminal part T1 of the flexible cable 4 into the recessed part 31 of the board-side connector 3. Next, once the insertion of the terminal part T1 of the flexible cable 4 is finished, the pair of immobilizing members 6, 6 are detached from the reinforcement member 5. This ensures that the end part 41 of the flexible cable 4 can be locally bent. After this, the foldable parts 511, 512, 513 of the reinforcement member 5 are folded and deformed, and the end part 41 of the flexible cable 4 is locally bent along the shapes of the foldable parts 511, 512, 513 after being folded and deformed (see FIG. 4). Thereafter, the cable attachment process is ended.

EFFECT OF INVENTION

According to the first and sixth aspects of the present invention, the foldable part of the reinforcement member allows local bending of the end part of the flexible cable, and therefore it is possible to make the detector smaller, in particular thinner even if a reinforcement member is attached to the flexible cable.

According to the second aspect of the present invention, the fordable part of the reinforcement member can be easily folded and deformed at the weakened part, and therefore it is possible to easily bend the end part of the flexible cable which is inserted into the connector.

According to the third aspect of the present invention, the foldable part of the reinforcement member can be easily folded and deformed at the slit shaped weakened part, and therefore it is possible to easily bend the end part of the flexible cable which is inserted into the connector.

According to the fourth aspect of the present invention, the reinforcement member can be split at the foldable part, and therefore it is possible to freely change the bent shape of the end part of the flexible cable which is inserted into the connector.

According to the fifth aspect of the present invention, the end part of the flexible cable inserted into the connector is bent with a relatively large curvature rate along a plurality of foldable parts, and therefore it is possible to easily bend the end part of the flexible cable which is inserted into the connector.

According to the sixth aspect of the present invention, the immobilizing member prevents the end part of the flexible cable from being bent during insertion into the connector, and therefore it is possible to securely insert the terminal part of the flexible cable into the connector.

The present invention is not limited to only the above embodiment and can be modified in various ways within the scope described in the claims. For example, the above embodiment illustrates an optical encoder using light emitting and light receiving elements, but the detector of the present invention may also be other types of detectors such as optical encoders using ring shaped magnets. Further, the reinforcement member of the flexible cable in the detector of the present invention may also be applied to various amplification circuits and interface conversion circuits etc. which are built into a detector. Furthermore, the reinforcement member of the flexible cable of the detector of the present invention may also include hinges or other such mechanical parts instead of the weakened parts in the above embodiment. The dimensions, shapes, materials, etc. of the parts of the above-mentioned detector 1 are only examples. Various dimensions, shapes, materials, etc. can be employed for the purpose of achieving the advantageous effects of the present invention.

The invention claimed is:

1. A method of producing a detector comprising a circuit board, a connector which is mounted on said circuit board, and a flexible cable which has a terminal part inserted in said connector, wherein, a reinforcement member of said flexible cable is attached to an end part of said flexible cable which includes said terminal part, said reinforcement member includes a foldable part which can be folded and deformed so as to allow local bending of said end part of said flexible cable, and said foldable part includes a weakened part which is formed to split by folding and deforming the foldable part, wherein the method of producing a detector comprising:

attaching to said reinforcement member, an immobilizing member which immobilizes said foldable part so that said end part of said flexible cable cannot be bent, inserting into said connector, said terminal part of said flexible cable together with said reinforcement member having said immobilizing member attached thereto, detaching said immobilizing member from said reinforcement member, and folding and deforming the foldable part of said reinforcement member to split said weakened part, and locally bending said end part of said flexible cable along said foldable part.

2. The method of producing the detector according to claim 1, wherein said weakened part is a slit or a perforation which is formed on said reinforcement member.

3. The method of producing the detector according to claim 1 or claim 2, wherein said reinforcement member includes a plurality of foldable parts.

* * * * *